US008189025B2

(12) United States Patent
Mori et al.

(10) Patent No.: US 8,189,025 B2
(45) Date of Patent: May 29, 2012

(54) THERMAL PRINTER

(75) Inventors: Yukihiro Mori, Shinagawa (JP); Yoshinari Takabatake, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 232 days.

(21) Appl. No.: 12/730,367

(22) Filed: Mar. 24, 2010

(65) Prior Publication Data

US 2010/0253759 A1 Oct. 7, 2010

(30) Foreign Application Priority Data

Apr. 1, 2009 (JP) ..... 2009-089268

(51) Int. Cl.
*B41J 11/00* (2006.01)

(52) U.S. Cl. ..... 347/220; 347/222

(58) Field of Classification Search ..... 347/220, 347/222; 400/120.01
See application file for complete search history.

(56) References Cited

U.S. PATENT DOCUMENTS 6,682,239 B2 * 1/2004 Mori et al. ..... 400/649
6,765,602 B2 * 7/2004 Mori ..... 347/220
7,446,790 B2 11/2008 Takabatake
7,492,393 B2 * 2/2009 Vu et al. ..... 348/222.1
7,780,367 B2 * 8/2010 Yoshioka ..... 400/120.16
2005/0036820 A1 2/2005 Watanabe et al.
2008/0068437 A1 * 3/2008 Hirai ..... 347/220
2008/0068438 A1 * 3/2008 Hirai ..... 347/220
2009/0103963 A1 * 4/2009 Takabatake et al. ..... 400/120.01
2010/0020154 A1 * 1/2010 Takahashi ..... 347/220
2010/0053297 A1 * 3/2010 Yokoyama ..... 347/220
2010/0141728 A1 * 6/2010 Takabatake et al. ..... 347/220

FOREIGN PATENT DOCUMENTS

DE 4135008 * 4/1992
JP 2005-059395 A 3/2005
JP 2007-118247 A 5/2007

* cited by examiner

*Primary Examiner* — Huan Tran

(74) *Attorney, Agent, or Firm* — IPUSA, PLLC

(57) ABSTRACT

A thermal printer includes a thermal head, a platen roller configured to press the thermal head, an engaging part configured to engage the platen roller provided at a side part of a main part where the thermal head is provided, and a spring part provided at a part of the side part so as to engage the platen roller with the engaging part. The spring part forms a part of a side surface of the engaging part. The spring part is made of a material the same as a material of the side part.

8 Claims, 11 Drawing Sheets

THERMAL PRINTER

CROSS-REFERENCE TO RELATED APPLICATIONS

This patent application is based upon and claims the benefit of priority of Japanese Patent Application No. 2009-089268 filed on Apr. 1, 2009 the entire contents of which are incorporated herein by reference.

BACKGROUND OF THE INVENTION

1. Field of the Invention

The present invention generally relates to thermal printers.

2. Description of the Related Art

The number of components of a thermal printer having a thermal printing part including a thermal head and a platen is relatively small and therefore it is easy to miniaturize the thermal printer. Accordingly, thermal printers have been widely applied as annex printers of cash registers, portable type terminal devices, ATMs (automatic teller machine) and other devices. As such a thermal printer, a printer where a platen is detachably provided on a frame body configured to support a thermal head, has been known. Here, the platen functions as a rear surface supporting body so that stable printing on a printing sheet (thermal paper) by the thermal head is realized.

In the above-mentioned platen detachable type thermal printer, by detaching the platen from the platen frame body, it is possible to easily and immediately perform an operation where a new printing roll which is supplied and exchanged is set in a printing stand-by state or an operation where a printing roll having been jammed in the printing part during a printing operation is removed. See, for example, Japanese Laid-Open Patent Application Publication No. 2005-59395 and Japanese Laid-Open Patent Application Publication No. 2007-118247.

In the meantime, in a conventional thermal printer, a platen roller is detached from the thermal head based on a rotational fulcrum of a cover as a center. Accordingly, variety of design of the printer may be limited. Furthermore, a thermal printer having a lower price has been in demand.

SUMMARY OF THE INVENTION

Accordingly, embodiments of the present invention may provide a novel and useful thermal printer solving one or more of the problems discussed above.

More specifically, the embodiments of the present invention may provide a thermal printer where a platen roller is detached by rotating about a fulcrum different from a rotational axis of a cover.

Another aspect of the embodiments of the present invention may be to provide a thermal printer, including:

a thermal head;

a platen roller configured to press the thermal head;

an engaging part configured to engage the platen roller provided at a side part of a main part where the thermal head is provided; and a spring part provided at a part of the side part so as to engage the platen roller with the engaging part;

wherein the spring part forms a part of a side surface of the engaging part; and the spring part is made of a material the same as a material of the side part.

Another aspect of the embodiments of the present invention may be to provide a thermal printer, including:

a main body part where a thermal head is provided;

an openable and closeable cover, the cover being connected to the main body part via a first rotational fulcrum;

a platen roller configured to press the thermal head provided at the cover; and a platen holding member connected to the cover via a second rotational fulcrum, the platen holding member being configured to hold the platen roller, wherein, in a case where the cover is being closed, while the platen holding member is rotated with respect to the second rotational fulcrum, the platen roller is engaged with an engaging part of the main body.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 3 through FIG. 11 of embodiments of the present invention.

First Embodiment

A first embodiment of the present invention is discussed.

Figure 1:
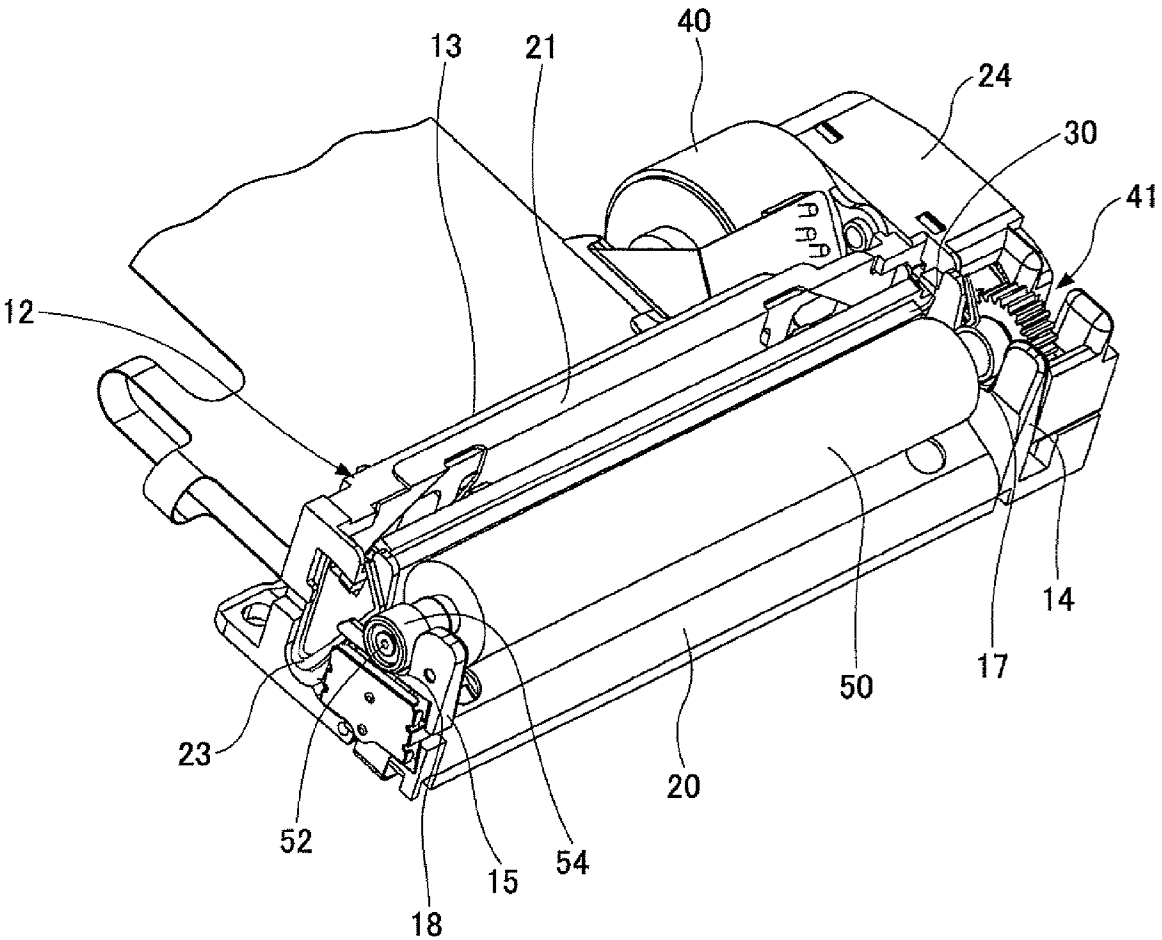
FIG. 1 is a partial perspective view of a related art thermal printer.

FIG. 1 is a partial perspective view of a related art thermal printer. The thermal printer shown in FIG. 1 has a frame 12. The frame 12 is made of diecast zinc. The frame 12 includes a main body part 13, side plate parts 14 and 15 situated one at each side of the main body part 13, and a shaft member projecting from the side plate part 14.

The side plate parts 14 and 15 include bearing parts 17 and 18, respectively, and concave parts. The bearing parts 17 and 18 are concave-shaped engaging parts. A platen roller holding spring member 23 is engaged with the above-mentioned concave parts.

In addition, the frame 12 includes a sheet guide member 20, a thermal head pressing plate spring member 21, the platen roller holding spring member 23, a gear box cover 24, and others. The platen roller holding spring member 23 is formed by bending a wire spring.

In addition, the thermal printer shown in FIG. 1 includes a thermal head 30, a platen roller driving motor 40, a reduction gear 41, and a platen roller 50.

The end parts of the thermal head 30 are engaged with the corresponding side plate parts 14 and 15 so that the thermal head 30 is provided along the main body part 13. In the thermal head 30, a force is applied by the thermal head pressing plate spring member 21 in a direction where the platen roller 50 is provided.

The motor 40 is provided at an internal side surface of the side plate part 14. The reduction gear 41 is supported by a shaft member. The gear box cover 24 is provided outside the side plate part 14 so as to cover the reduction gear 41.

The platen roller 50 can be detached. In a state where the platen roller 50 is attached, bearings 54 connected to a shaft member 52 projecting to both sides are engaged in the bearing parts 17 and 18. By pushing the bearings 54 by the platen roller holding spring members 23, the platen roller 50 is held by the bearing parts 17 and 18. In this embodiment, a case where the bearings 54 are provided is discussed. In a case where the bearings 54 are not provided, the shaft part 52 is held in an engaging part corresponding to the bearing parts 17 and 18.

Figure 2:
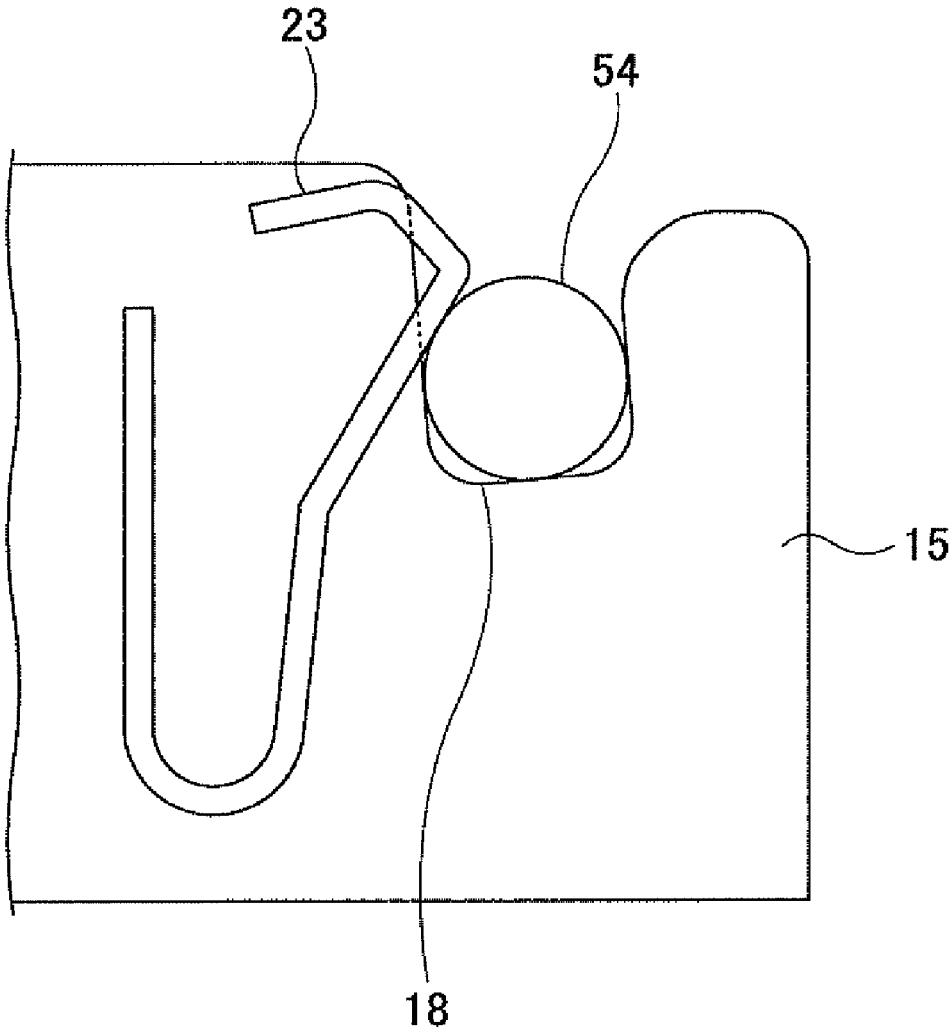
FIG. 2 is a partial side view of the related art thermal printer.

FIG. 2 is a partial side view of the related art thermal printer shown in FIG. 1. The bearing 54 of the platen roller 50 is engaged in the bearing part 18 of the side plate part 15 by the platen roller holding spring member 23. The platen roller holding spring member 23 is made of a material such as a metal or the like which is a material different from the material of the side plate part 15.

Figure 3:
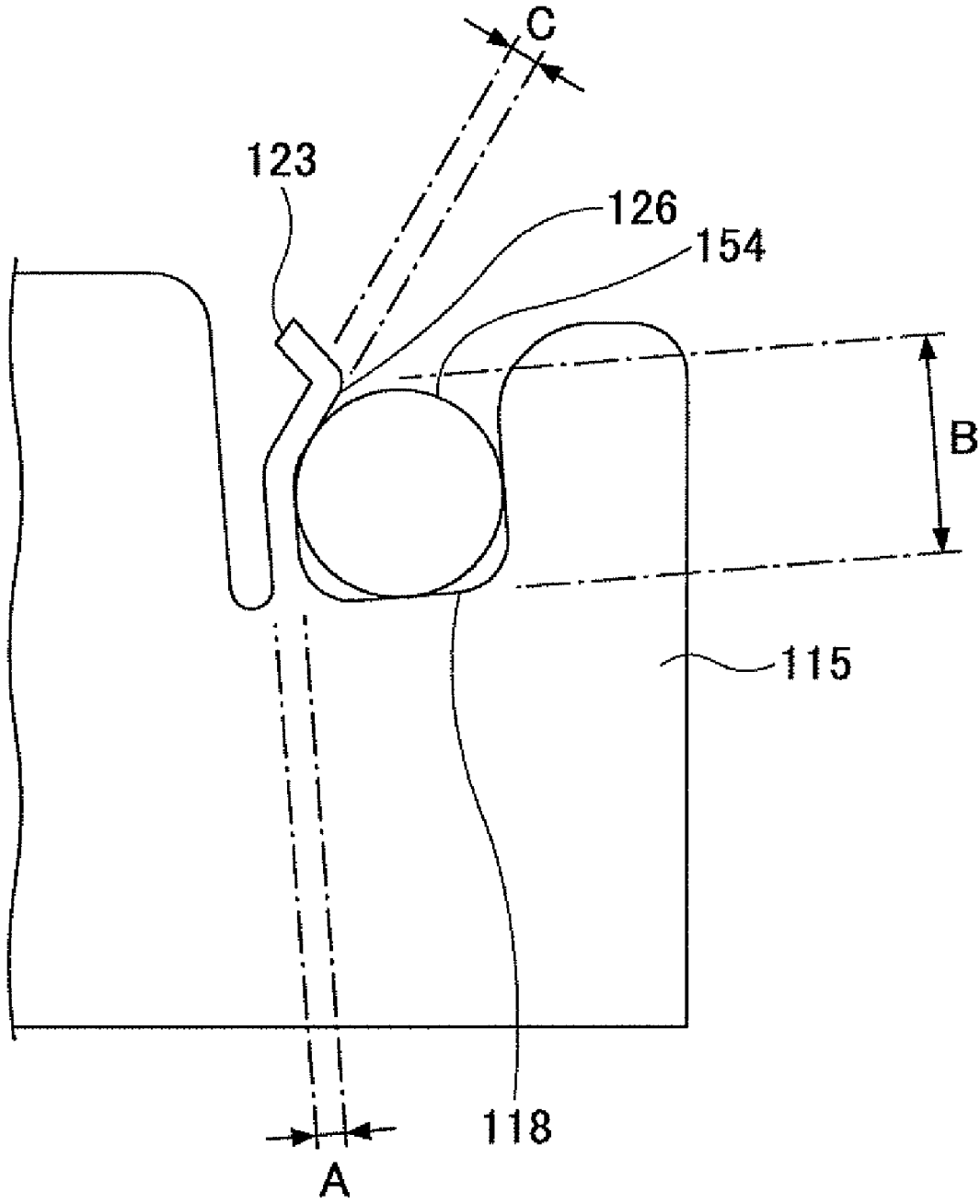
FIG. 3 is a partial side view of a thermal printer of a first embodiment of the present invention.
Figure 4:
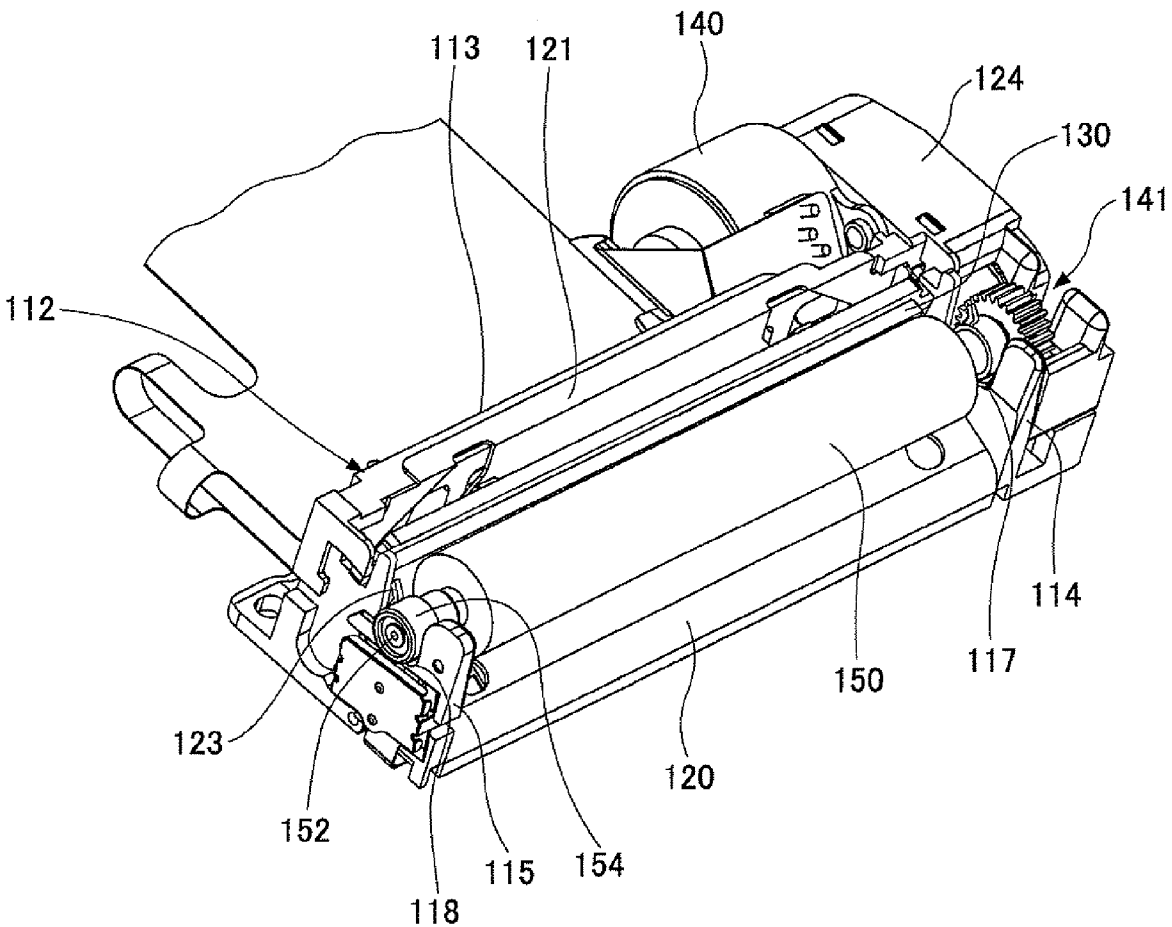
FIG. 4 is a partial perspective view of the thermal printer of the first embodiment of the present invention.

FIG. 3 is a partial side view of a thermal printer of a first embodiment of the present invention. FIG. 4 is a partial perspective view of the thermal printer of the first embodiment of the present invention.

The thermal printer of the first embodiment of the present invention has a structure at each side where a platen roller holding spring member is provided at a part of a side plate part of a main body of the thermal printer.

In other words, as shown in FIG. 3, a bearing 154 of a platen roller is engaged in a bearing part 118 of a side plate part 115 of the main body of the thermal printer by a spring part 123. The spring part 123 forms a part of a wall surface of the bearing part 118. A curved part 126 is provided at a head end of the spring part 123. A force is applied to the bearing 154 by the curved part 126 in an inward direction so that the bearing 154 is engaged in the bearing part 118 of the side plate part 115.

More specifically, the thermal printer of the first embodiment of the present invention includes a frame 112. The frame 112 is made of diecast zinc. The frame 112 includes a main body part 113, side plate parts 114 and 115 situated one at each side of the main body part 113, and a shaft member projecting from the side plate part 114.

The side plate parts 114 and 115 include bearing parts 117 and 118, respectively, and the spring parts 123. The bearing parts 117 and 118 are concave-shaped engaging parts.

In addition, the frame 112 includes a sheet guide member 120, a thermal head pressing plate spring member 121, the side plate parts 114 and 115 where the spring parts 123 are formed, a gear box cover 124, and others. In addition, the thermal printer shown in FIG. 3 and FIG. 4 includes a thermal head 130, a platen roller driving motor 140, a reduction gear 141, and a platen roller 150.

Corresponding end parts of the thermal head 130 are engaged with the side plate parts 114 and 115 so that the thermal head 130 is provided along the main body part 113. In the thermal head 130, a force is applied by the thermal head pressing plate spring member 121 in a direction where the platen roller 150 is provided.

The motor 140 is provided at an internal side surface of the side plate part 114. The reduction gear 141 is supported by a shaft member. The gear box cover 124 is provided outside the side plate part 114 so as to cover the reduction gear 141.

The platen roller 150 can be detached. In a state where the platen roller 150 is not detached, bearings 154 connected to shaft members 152 projecting to both sides are engaged in the bearing parts 117 and 118. By pushing the bearings 154 with the spring parts 123, the bearings 154 are held by the bearing parts 117 and 118.

The spring parts 123 are parts of the side plate parts 114 and 115 of the main body of the thermal printer. Hence, the spring parts 123 are made of the same material as a material of the side plate parts 114 and 115. A metal material, a resin material or the like can be used as the material of the spring parts 123. It is possible to adjust forces applied to the bearings 154 in order to engage the bearings 154 with the bearing parts 117 and 118 by adjusting a width A of the spring parts 123, a length B between a connecting part of the side plate parts 114 and 115 and the spring parts 123 and a top part of the curved parts 126 of the spring parts 123, and a width C of the spring parts 123 at the curved parts 126.

Thus, by providing the spring parts 123 at parts of the side plate parts 114 and 115 of the main body part 113 of the thermal printer, it is possible to reduce the number of components of the thermal printer and to provide the thermal printer with a low price.

Second Embodiment

A second embodiment of the present invention is discussed.

Figure 5:
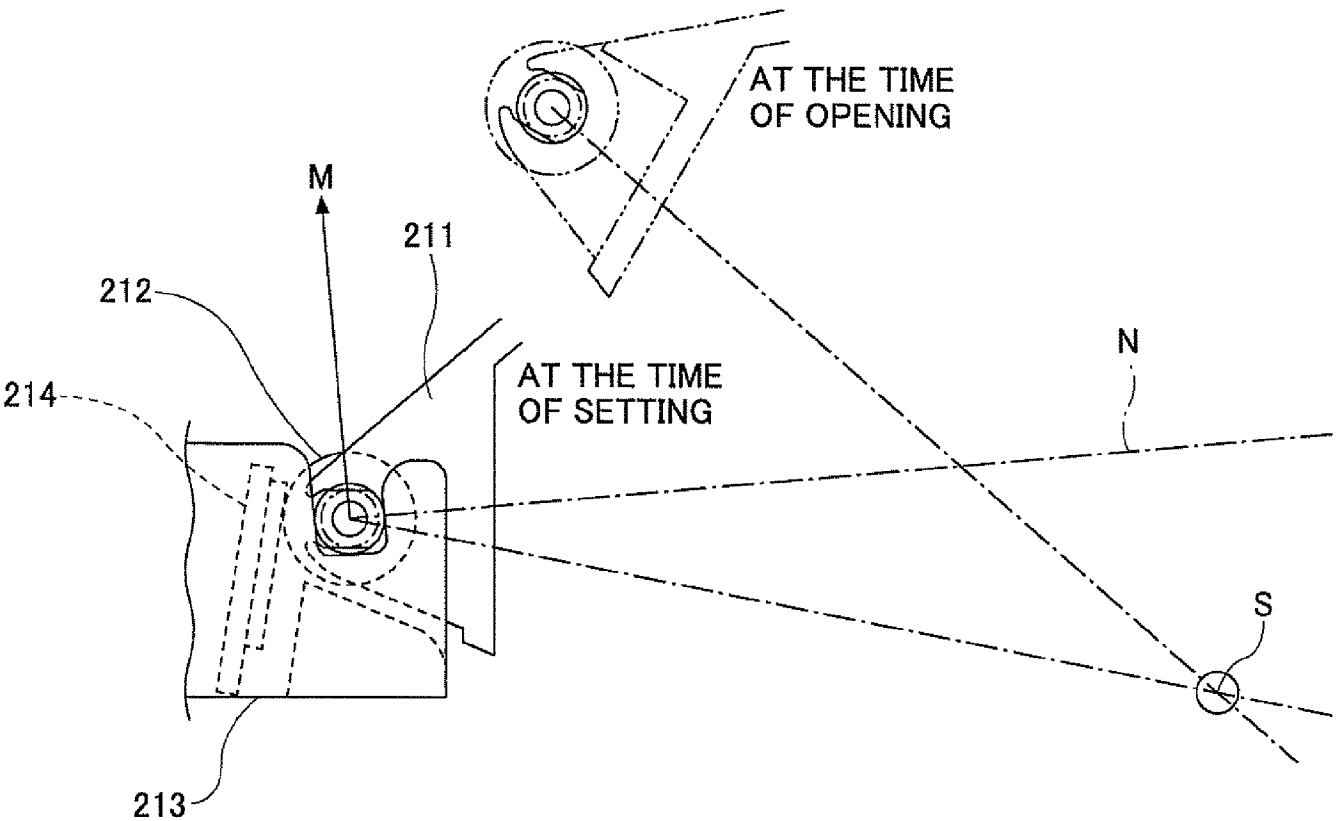
FIG. 5 is a view for explaining another related art thermal printer.

FIG. 5 is a view for explaining another related art thermal printer.

As shown in FIG. 5, in this thermal printer, as a cover not shown in FIG. 5 is opened or closed, a platen roller 212 held by a platen holding part 211 is detached from or attached to a thermal head 214 provided at a main body part 213. The cover not shown in FIG. 5 is rotated with respect to a rotational fulcrum S. When the cover is opened, the platen holding part 211 and the platen roller 212 are moved in a position indicated by a dotted line in FIG. 5.

A bearing taking-out direction of the platen roller 212 is a direction indicated by an arrow M. The cover rotational fulcrum S is situated at a lower side relative to a line N perpendicular to the bearing taking-put direction M. In this embodiment, the bearing taking-our direction has the same meaning of an axis taking-out direction.

In this embodiment, in addition to the cover rotational fulcrum, a rotational fulcrum of the platen holding member 211 different from the cover rotational fulcrum is provided.

Details of a thermal printer of the second embodiment of the present invention are discussed with reference to FIG. 6 through FIG. 9.

Here, FIG. 6 through FIG. 9 are views showing stages for closing a cover 240 relative to a main body part 230.

Figure 6:
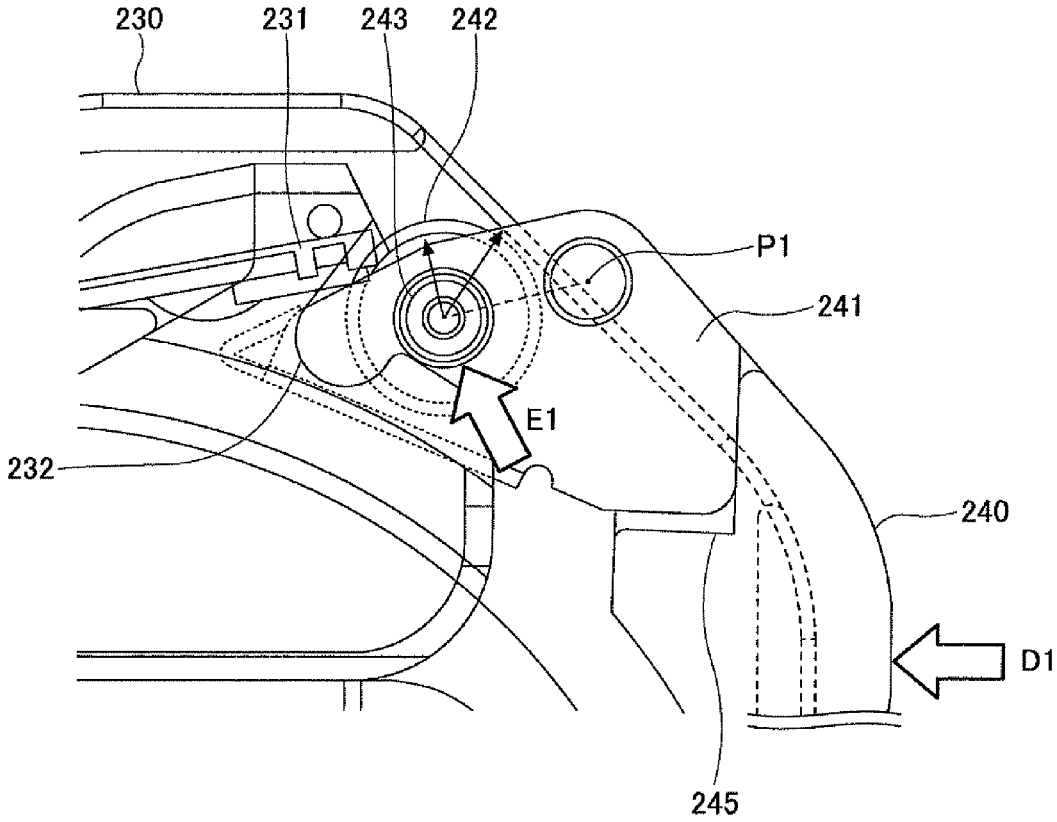
FIG. 6 is a first view for explaining opening and closing states of a thermal printer of a second embodiment of the present invention.
Figure 6:
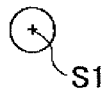

First, as shown in FIG. 6, when a cover 240 is being closed relative to a main body part 230, a force is applied to the cover 240 in a direction indicated by an arrow D1. A thermal head 231 and a bearing part 232 are provided at the main body part 230.

The cover 240 is rotated with respect to a cover rotational axis S1 which is a first rotational fulcrum. By the force applied in the direction indicated by the arrow D1, a force in a direction indicated by an arrow E1 is applied to a bearing 243 of a platen roller 242 via a platen holding member 241. This force works in an upper direction and a right upper direction relative to the bearing 243. Because of this, the platen holding member 241 is rotated with respect to a platen rotational fulcrum P1 which is a second rotational fulcrum. A limitation to rotation where the platen rotational axis P1 is a rotational axis is provided to the platen holding member 241 at a side part of a rotational limitation part 245 provided at the cover 240.

Figure 7:
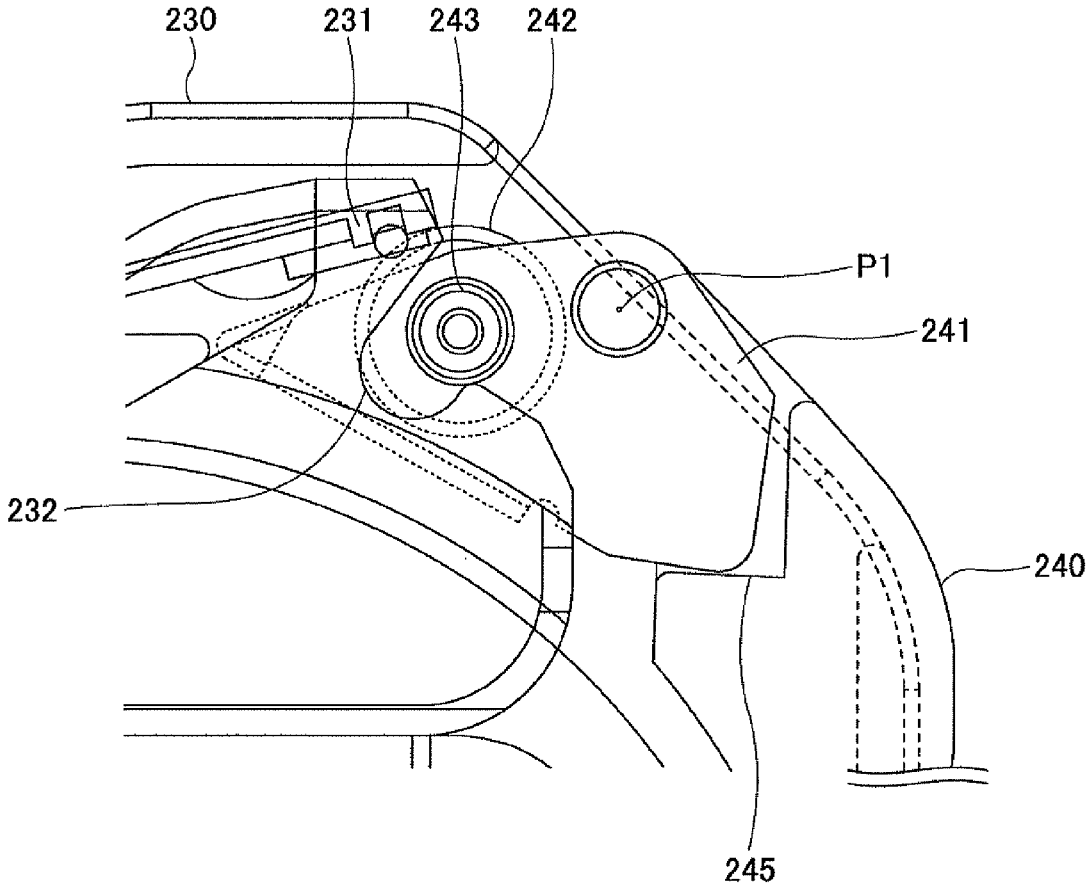
FIG. 7 is a second view for explaining the opening and closing states of the thermal printer of the second embodiment of the present invention.
Figure 7:
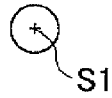

Next, as shown in FIG. 7, when the force is further applied in the direction where the cover 240 is being closed, although the platen holding member 241 is rotated where the platen rotational fulcrum P1 is an axis of the rotation, the rotation is limited at a bottom part of the rotational limitation part 245 provided at the cover 240.

Figure 8:
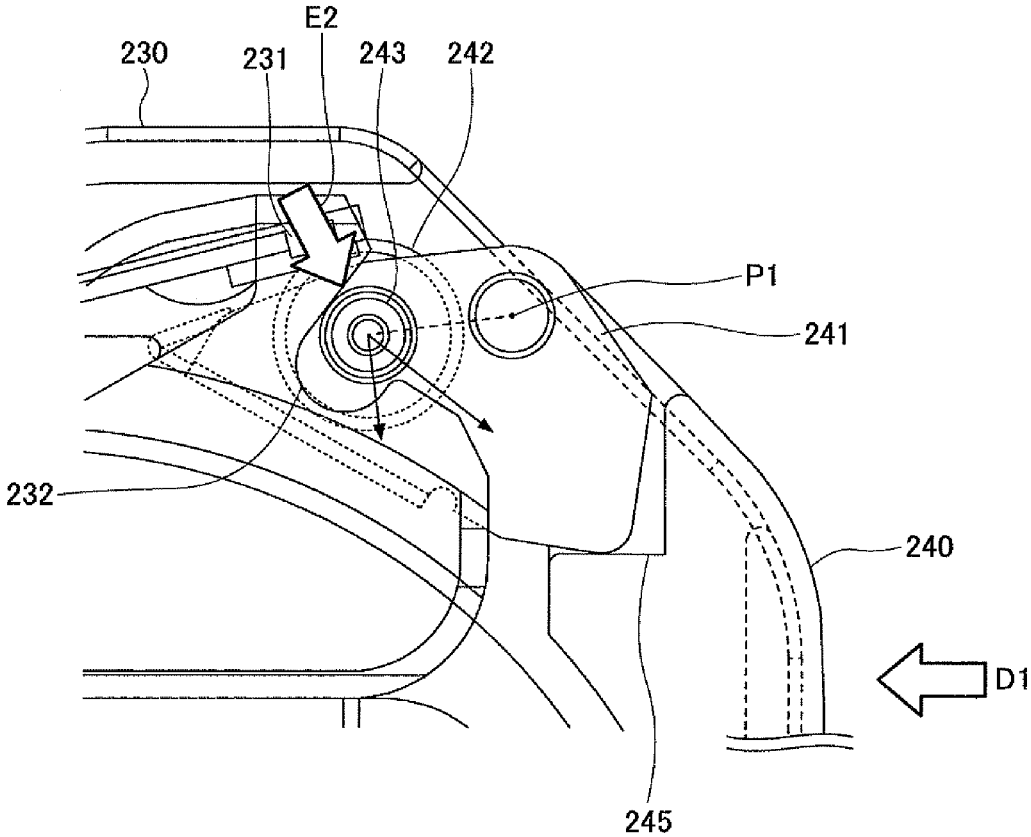
FIG. 8 is a third view for explaining the opening and closing states of the thermal printer of the second embodiment of the present invention.
Figure 8:
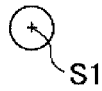

Next, as shown in FIG. 8, when the force is further applied in the direction where the cover 240 is being closed, due to the force applied in the direction indicated by the arrow D1, a force is applied in a direction indicated by an arrow E2 at the bearing 243 of the platen roller 242. This force works in a lower direction and a right lower direction relative to the bearing 243. Because of this, the platen holding member 241 is rotated with respect to the platen rotational fulcrum P1 which is the second rotational fulcrum.

Figure 9:
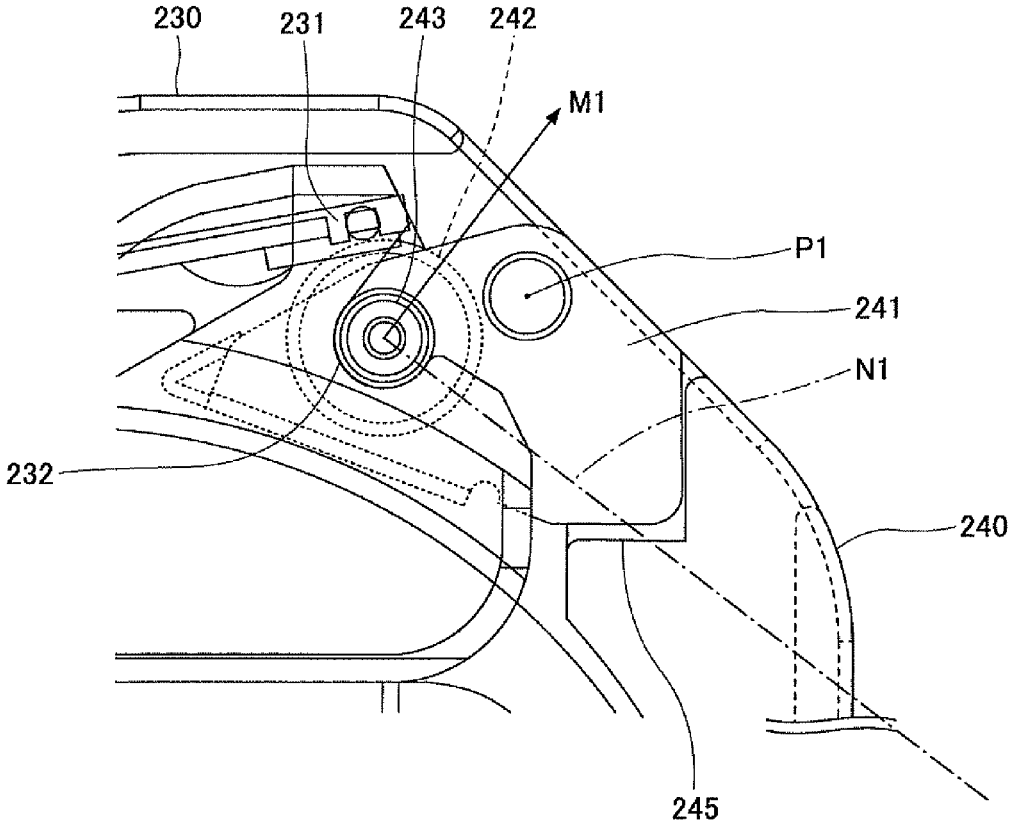
FIG. 9 is a fourth view for explaining the opening and closing states of the thermal printer of the second embodiment of the present invention.
Figure 9:
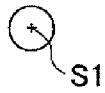

Next, as shown in FIG. 9, when the cover 240 is completely closed, the bearing 243 of the platen roller 242 is engaged with the bearing part 232 of the main body part 230. Although the platen holding member 241 is rotated where the platen rotational fulcrum P1 is an axis of the rotation until this state is reached, the rotation is limited at the side part of the rotational limitation part 245 provided at the cover 240.

In this thermal printer, the platen holding member 241 is rotated with respect to a rotational axis different from the cover rotational axis S1 of the cover, namely, the platen rotational fulcrum P1. This platen rotational fulcrum P1 is situated in a bearing taking-out direction side of the line N1 perpendicular to the bearing taking-out direction of the bearing 232 indicated by the arrow M1. The cover rotational axis S1 of the cover 240 is situated at a side of the perpendicular line N1 in a direction opposite to the bearing taking-out direction. The platen rotational fulcrum P1 is situated at a side of the perpendicular line N1, which is a different side from a side where the cover rotational axis S1 of the cover 240 is provided.

Thus, it is possible to expand the variety of the designs of the entirety of the thermal printer by providing the platen rotational fulcrum P1 different from the cover rotational axis S1 of the cover 240.

In this embodiment, a length between the center of the axis of the platen roller 242 and the cover rotational axis S1 which is the first rotational fulcrum is greater than a length between the center of the axis of the platen roller 242 and the platen rotational fulcrum P1 which is the second rotational fulcrum.

Next, a structure of the thermal printer of the second embodiment of the present invention is discussed with reference to FIG. 10 and FIG. 11.

Figure 10:
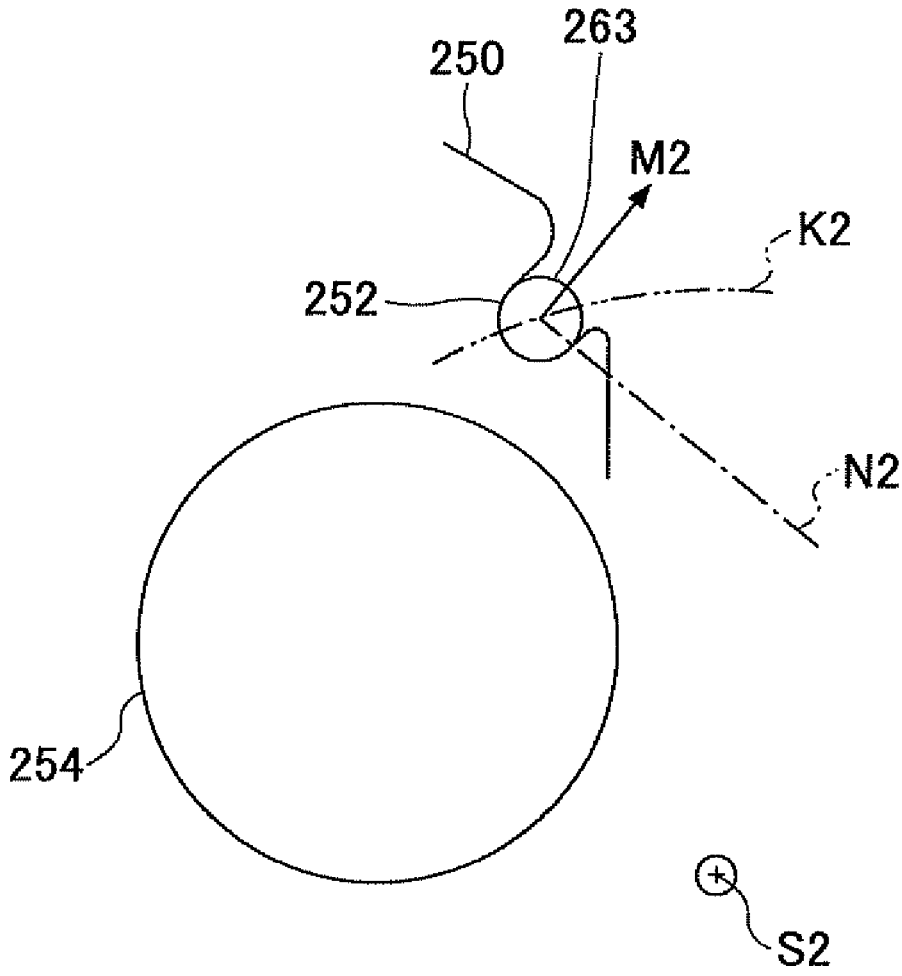
FIG. 10 is a partial structural view of another related art thermal printer.

FIG. 10 is a partial structural view of another related art thermal printer. FIG. 11 is a partial structural view of the thermal printer of the second embodiment of the present invention.

In the related art thermal printer shown in FIG. 10, a bearing part 252 is provided at a main body part 250. A platen roller provided at the cover not shown in FIG. 10 includes a bearing 263. A bearing taking-out direction of the bearing 263 is indicated by an arrow M2 in FIG. 10.

The cover not shown in FIG. 10 is rotated with respect to the cover rotational fulcrum S2 and opened and closed relative to the main body part 250. The cover is situated at a lower side of a line N2 perpendicular to the bearing taking-out direction indicated by the arrow M2. The bearing 263 is engaged with the bearing part 252 by opening and closing of the cover not shown in FIG. 10. A two-dotted line K2 indicates the track of the center of the bearing 263 in a case where the cover is rotated with respect to the rotational fulcrum S2. A sheet roll 254 is provided at the main body part 250.

Figure 11:
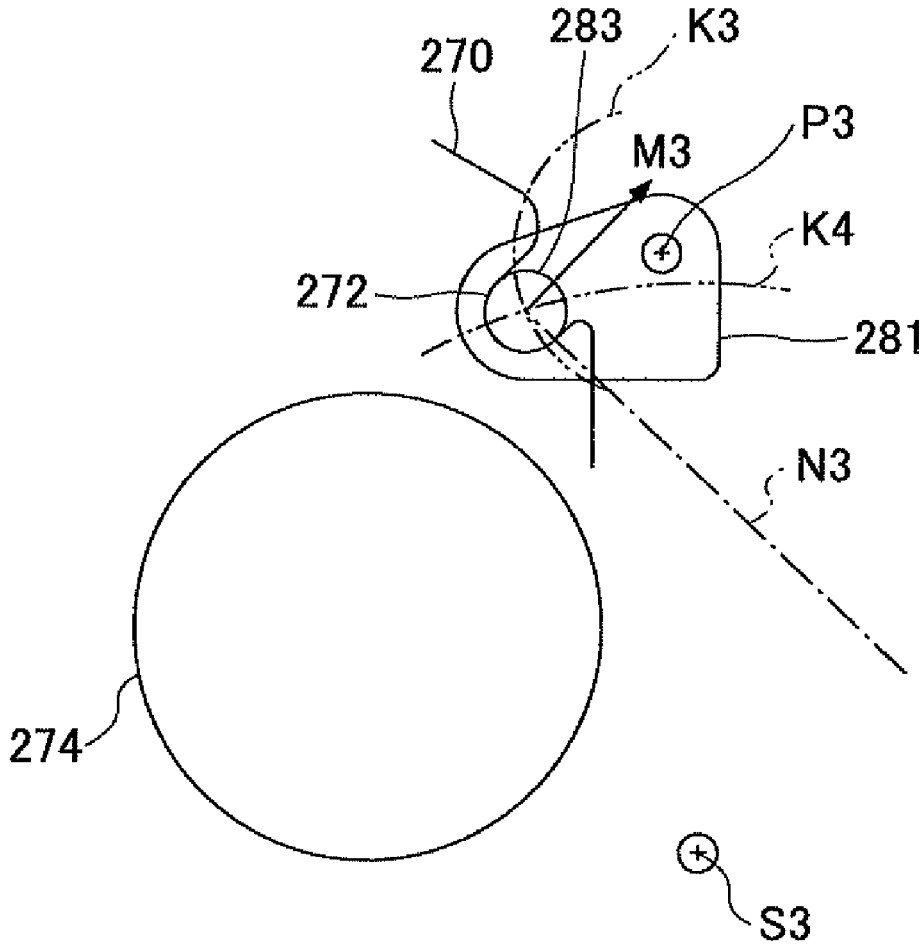
FIG. 11 is a partial structural view of the thermal printer of the second embodiment of the present invention.

On the other hand, in a thermal printer of this embodiment shown in FIG. 11, a bearing part 272 is provided at a main body part 270. A platen holding member 281 is provided at the cover not shown in FIG. 11. A platen roller is held by the platen holding member 281. This platen roller includes a bearing 283. A bearing taking-out direction of the bearing 283 is indicated by an arrow M3 in FIG. 11.

The cover not shown in FIG. 11 is rotated with respect to a cover rotational fulcrum S3 and opened and closed relative to the main body part 270. The cover is situated at a lower side of a line N3 perpendicular to the bearing taking-out direction indicated by the arrow M3.

On the other hand, the platen holding member 281 is provided at the cover not shown in FIG. 11 so as to be rotated with respect to a platen rotational fulcrum P3 which is a second rotational fulcrum. The platen holding member 281 is situated at an upper side of the perpendicular line N3.

Accordingly, in the thermal printer of this embodiment, the platen rotational fulcrum P3 is provided. The platen rotational fulcrum P3 is situated at a side opposite to that of the cover rotational fulcrum S3 of the perpendicular line N3.

The bearing 283 is engaged with the bearing part 272 by rotating the platen holding member 281 with respect to the platen rotational fulcrum P3. A two-dotted line K3 indicates the track of the center of the bearing 283 in a case where the platen holding member 281 is rotated where the platen rotation fulcrum P3 is the axis of rotation. A two-dotted line K4 indicates the track of the center of the bearing 263 in a case where the cover not shown in FIG. 11 is rotated where the platen rotation fulcrum S3 is the axis of rotation. A sheet roll 274 is provided at the main body part 270.

According to the above-discussed embodiments, it is possible to provide a thermal printer with a low price, the thermal printer being where the variety of designs of the printer can be expanded.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A thermal printer, comprising:

a thermal head;

a platen roller;

an engaging part configured to engage the platen roller provided at a side part of a main part where the thermal head is provided; and a spring part provided at a part of the side part so as to engage the platen roller with the engaging part, wherein a plurality of portions of the spring part are in contact with a part of the platen roller;

wherein the spring part forms a part of a side surface of the engaging part, and the spring part is made of a material the same as a material of the side part, and wherein the spring part includes a bended part between those portions of the spring part that are in contact with a part of the platen roller.

2. The thermal printer as claimed in claim 1, wherein the spring part includes a curved part where a force is applied in an inward direction of the engaging part at the platen roller so that the platen roller is engaged with the engaging part.

3. The thermal printer as claimed in claim 1, wherein the side part and the spring part are made of one of a resin material and a metal material.

4. A thermal printer, comprising:

a thermal head;

a main body part that includes an engaging part;

an openable and closeable cover being connected to the main body part via a first rotational fulcrum;

a platen roller; and a platen holding member rotatably connected to the cover via a second rotational fulcrum, the platen holding member being configured to hold the platen roller, wherein, when the cover is being closed, the platen holding member rotates with respect to the second rotational fulcrum, and the platen roller is engaged with the engaging part of the main body.

5. The thermal printer as claimed in claim 4, wherein the second rotational fulcrum is provided at a side opposite to that of the first rotational fulcrum of a line perpendicular to an axis taking-out direction of the platen roller.

6. The thermal printer as claimed in claim 4, wherein a length between the center of an axis of the platen roller and the first rotational fulcrum is greater than a length between the center of an axis of the platen roller and the second rotational fulcrum.

7. The thermal printer as claimed in claim 4, further comprising:

a rotation control part that is provided at the cover and that limits rotation of the platen holding member with respect to the second rotational fulcrum.

8. A printer, comprising:

a main body part that includes an engaging part;

a print head;

a cover being rotatably connected to the main body part via a first rotational fulcrum;

a platen roller; and a holding member that is rotatably connected to the cover via a second rotational fulcrum and that holds the platen roller, wherein, when the cover is being closed, the holding member rotates with respect to the second rotational fulcrum, and the platen roller is engaged with the engaging part.

* * * * *